US006250394B1

(12) United States Patent
Mashburn

(10) Patent No.: US 6,250,394 B1
(45) Date of Patent: Jun. 26, 2001

(54) APPARATUS FOR ASSISTING THE ADVANCEMENT OF A WORK STRING AND METHOD

(76) Inventor: Benny Donald Mashburn, 103 Turn Row, Lafayette, LA (US) 70508

( * ) Notice: Subject to any disclaimer, the term of this patent is extended or adjusted under 35 U.S.C. 154(b) by 0 days.

(21) Appl. No.: 09/404,944

(22) Filed: Sep. 23, 1999

(51) Int. Cl.[7] ..... E21B 17/00; E21B 17/10

(52) U.S. Cl. ..... 166/382; 166/241.3; 166/241.6; 166/241.7; 175/325.3

(58) Field of Search ..... 166/77.2, 241.3, 166/241.6, 241.7, 382; 175/325.3

(56) References Cited

U.S. PATENT DOCUMENTS

| | | | | |
|---|---|---|---|---|
| 484,947 | * | 10/1892 | Black | 166/241.3 |
| 4,747,452 | * | 5/1988 | Clark | 166/311 |
| 4,958,692 | * | 9/1990 | Anderson | 175/323 |
| 5,355,950 | | 10/1994 | Zwart . | |
| 5,358,042 | * | 10/1994 | Stoltz | 166/241.6 |
| 5,692,563 | * | 12/1997 | Krueger et al. | 166/85.5 |
| 5,848,647 | * | 12/1998 | Webre et al. | 166/379 |

* cited by examiner

*Primary Examiner*—William Neuder
*Assistant Examiner*—Jennifer M Hawkins
(74) *Attorney, Agent, or Firm*—Domingue & Waddell, PLC

(57) ABSTRACT

An apparatus for assisting the advancement of a work string. In the preferred embodiment, the work string is concentrically disposed within a highly deviated tubular member. The apparatus comprises a cylindrical member having a first half clamp and a second half clamp having an arcuate inner portion, with the first half clamp and second half clamp being connected with a hinge. The apparatus further includes a first housing attached to the first half clamp and a second housing attached to the second half clamp. The apparatus further comprises a first roller inserted into the first housing and a second roller inserted into the second housing. In the preferred embodiment, the first and second rollers are spherical. The apparatus may further comprise a first deflector plate operatively associated with a first side of the first housing and the second housing. The first deflector plate has a first end adjacent the cap member and a second end adjacent the first half body so that an angled end is formed. A second deflector plate may also be included, with the second plate being operatively associated with a second side of the first and the second housing, with the first deflector plate having a first end adjacent the cap member and a second end adjacent the first half clamp so that an angled end is formed. The apparatus may further comprise a third housing containing having a third roller disposed therein. Also disclosed is a method for advancing a tubular work string within a highly deviated well bore.

12 Claims, 8 Drawing Sheets

APPARATUS FOR ASSISTING THE ADVANCEMENT OF A WORK STRING AND METHOD

BACKGROUND OF THE INVENTION

This invention relates to an apparatus for assisting the advancement of a tubular work string. More particularly, but not by way of limitation, this invention relates to an apparatus and method for advancing a tubular work string in a highly deviated or horizontal concentric tubular member.

As those of ordinary skill in the art will recognize, tubular members are used to transport liquids and gases from a first processing facility to a second processing facility. Also, tubular members are used to convey hydrocarbons from subterranean reservoirs to surface production facilities. The hydrocarbons are then transported from the production facilities to processing plants, such as an oil and gas refinery.

In each instance of conveyance, the tubular member may become coated with deposits that impede the transportation. The deposits may cause and/or accelerate corrosion. Also, it is sometimes necessary to perform certain types of remedial work to the inner diameters of the tubular members. For instance, in the case were the tubular member is a well bore completed to a subterranean reservoir, down hole tools may need to be set within the well bore, or alternatively, down hole tools may need to be retrieved. Regardless of the specific application, a concentric tubular member can be run in order to perform the desired work.

One means for accomplishing these task includes use of a coiled tubing string. The coiled tubing string is inserted into the inner diameter of the tubular member. The coiled tubing string will have the necessary down hole assembly in order to perform the desired task. For instance, the coiled tubing may have a wash tool adapted on one end, with the wash tool configured to deliver a cleaning solution to the inner diameter of the tubular walls. Another example is the coiled tubing may have a tool selectively attached thereto, with the tool being designed to be set into the inner diameter of the tubular member. Examples of tools used in this instance includes packers, plugs, screens, liners, etc. The examples herein given are illustrative and not exhaustive.

A problem encountered during operation is that the concentrically placed work string will lie on and rub the inner diameter portion of the tubular string. This causes problems in the advancement of the tubular work string as well as adding to the potential wear and tear which in turn could lead to failure of the work string. Sometimes, the problem of friction becomes so severe that it is not possible to retrieve the work string.

Operators have devised certain devices to aid in the advancement of the work strings. For instance, there has been developed a centralizer that works to center and stabilize the work string within the inner diameter of the tubular member. However, there is need for an apparatus that will centralize the work string and also reduce the friction between the work string and the inner diameter wall so that advancement is accelerated. Also, objects within the tubular member may impede advancement of the work string. Thus, there is a need for an apparatus that will deflect these objects which in turn will allow for proper advancement of the work string.

SUMMARY OF THE INVENTION

An apparatus for assisting the advancement of a work string is disclosed. In the preferred embodiment, the work string is concentrically disposed within a highly deviated tubular member. The apparatus comprises a cylindrical member having a first half body having an arcuate inner portion and a second half body having an arcuate inner portion, and wherein a hinge connects said first half body with said second half body about the tubular work string. The inner portion of the first and second half bodies may include a series of teeth that engage the tubular work string. The apparatus further includes a first housing member attached to said first half body and a second housing member attached to the second half body.

The apparatus further comprises a first roller member inserted into the first housing member and a second roller member inserted into the second housing member. In the preferred embodiment, the first and second roller members are spherical members, with the spherical members being rotatable within the housings in a 360 degree phase. A clamping means for attaching the first half body with the second half clamp about the tubular work string is also included.

In the preferred embodiment, the first and second housing contains a cylindrical projection mounted perpendicular relative to the tubular work string, an insert disposed within the cylindrical projection, and a cap member having an opening therein, with the cap member being attached to the insert. The cap member and the insert form a chamber that contains the spherical member, with a portion of the spherical member protruding from the cap's opening.

The apparatus may further comprise a first deflector plate operatively associated with a first side of the first housing and the second housing. The first deflector plate has a first end adjacent the cap member and a second end adjacent the first half body so that an angled end is formed. A second deflector plate may also be included, with the second plate being operatively associated with a second side of the first and the second housing, with the first deflector plate having a first end adjacent the cap member and a second end adjacent the first half clamp so that an angled end is formed.

The apparatus may further comprise a third housing member containing a first half-cylindrical projection mounted perpendicular relative to the first half clamp and a second half-cylindrical projection mounted perpendicular relative to the second half clamp, and wherein said first half-cylindrical projection and the second half-cylindrical projection form a cylindrical member. An insert, disposed within the cylindrical member, and a cap member having an opening therein is also included. The cap member is attached to the insert, with the cap member and the insert forming a chamber having a third spherical member disposed therein. A portion of the third spherical member protrudes from the opening of the cap.

In the preferred embodiment, the clamping means comprises a passage through the first half-cylindrical projection and the second half-cylindrical projection; a pin placed within the passage; external thread means located on the pin; internal thread means located in the passage and adapted to threadedly engage the external thread means; and wherein the engagement of the pin via the threads within the passage tightens the first half clamp and the second half clamp about the tubular work string. There may also be included a lock means for locking the housing onto the apparatus so that the housing does not back off from the sleeve and wherein the lock means is a notch profile on the deflector plate engaging a shoulder on the housing.

Also disclosed is a method for advancing a tubular work string within a highly deviated well bore. The method comprises clamping a skate apparatus about the tubular work string. The skate apparatus comprises: a clamp; a first, second, and third housing member attached to the clamp, with the first, second and third housing member having a first, second and third spherical rollers disposed therein; a first deflector plate operatively associated with a first side of the first, second and third housing. The first deflector plate will contain a first end adjacent a top end of the first, second and third housing and a second end adjacent the clamp so that an angled end is formed.

The method includes placing the skate apparatus about the tubular work string in the highly deviated well bore and contacting the first spherical roller and the second spherical roller on an inner portion of the tubular work string. Next, the operator would impart a force in a first direction on the tubular work string which in turn causes the first and second spherical rollers to roll on the inner portion of the tubular work string which in turn advances the tubular work string in the first direction in the highly deviated well bore.

In one of the embodiments, the well bore may contain a first object, and wherein the method would further comprise contacting the first object with the first deflector plate and deflecting the first object on the angled end of the deflector plate.

In yet another preferred embodiment, the skate apparatus will further comprise a second deflector plate operatively associate with a second side of the first, second, and third housing. The second deflector plate has a first end adjacent the cap member and a second end adjacent the clamp so that an angled end is formed. The well bore will contain a second object. The method further includes imparting the force in a second direction on the tubular work string which in turn causes the first and second spherical rollers to roll on the inner diameter portion of the tubular work string. The tubular work string is advanced in the second direction in the highly deviated well bore. The method includes contacting the second object with the second deflector plate and deflecting the second object on the angled end of the second deflector plate.

An advantage of the present invention includes the ability to work in highly deviated or horizontal tubular members. Another advantage is that the invention may be used in subterranean well bores, surface pipelines, flowlines, etc. Yet another advantage is that the invention is adaptable to coiled tubing, work strings, drill string, etc.

Still yet another advantage is that several devices may be spaced along a work string so that support is given to the entire length of the work string. Another advantage is that the device centralizes and stabilizes the work string within a concentric tubular member. Another advantage is that the device reduces the chances of the work string becoming lodged within the tubular member.

A feature of the present invention includes the deflector plate that can deflect objects within well bore away from the apparatus. Another feature includes the deflector plate which protects sphereical rollers. Yet another feature includes the deflector plate supports and strengthens the housing containing the rollers.

Still yet another feature is the roller used in the preferred embodiment rotates in 360 degree phase i.e. the roller can roll forward, backward, sideways and any component thereof Another feature is that the three rollers may be spaced equally about the clamp body. Another feature is that the device has a three point potential contact with the inner diameter of the tubular member. Yet another feature is the clamping means allows the operator to clamp and tighten the apparatus at a desired point on the work string.

DETAILED DESCRIPTION OF THE PREFERRED EMBODIMENTS

Figure 1:
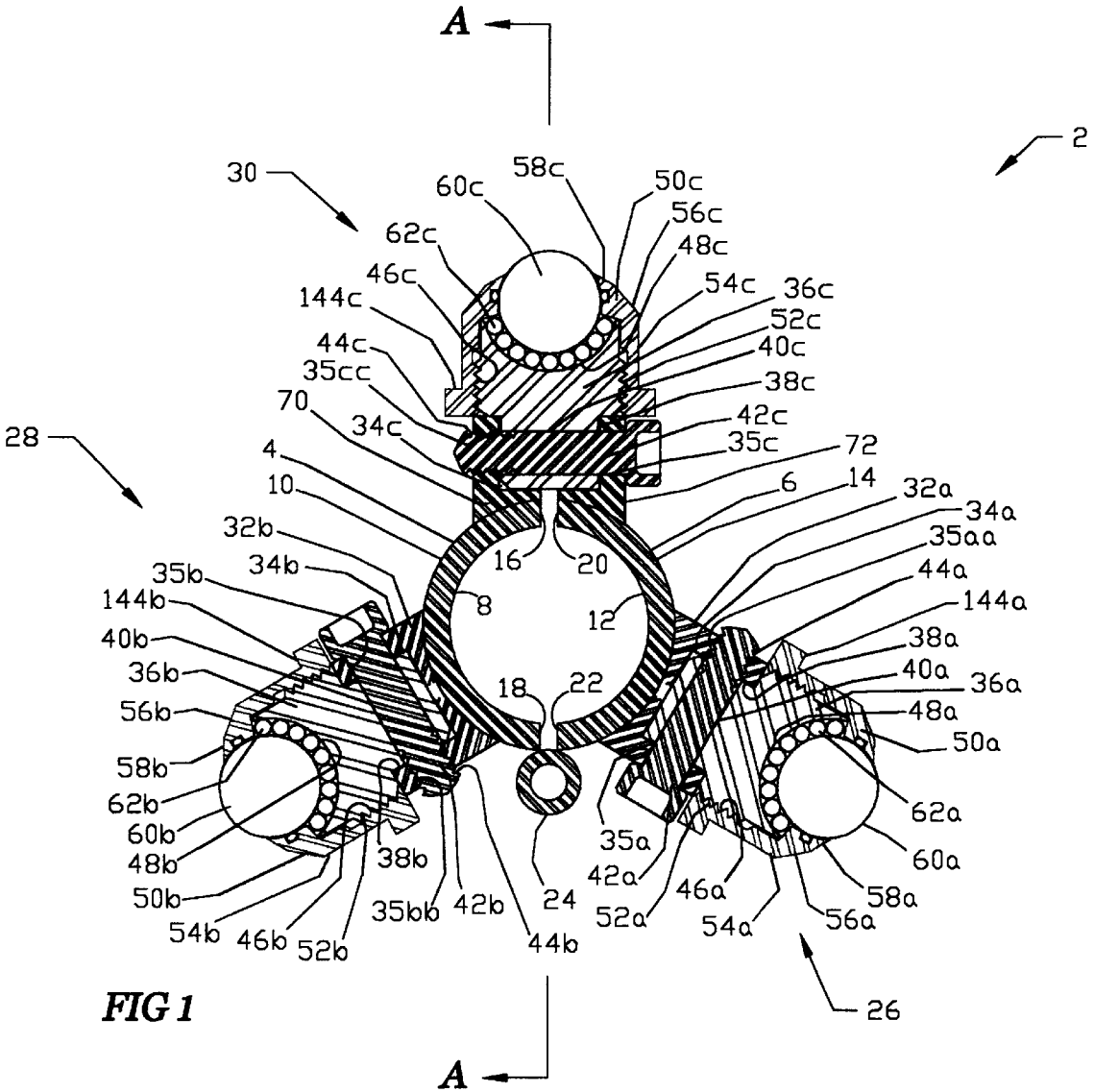
FIG. 1 is a cross-sectional view of the novel apparatus of the present invention.

Referring now to FIG. 1, a cross-sectional view of the novel apparatus 2 of the present invention will now be described. The apparatus 2 includes a first sleeve half body 4 and a second sleeve half body 6, with the sleeve half body 4 and 6 being generally cylindrical when mated together. The half body 4 will have an arcuate inner portion 8 and an outer portion 10. The half body 6 will have an arcuate inner portion 12 and an outer portion 14. The half body 4 has a first end surface 16 and a second end surface 18 while the half body 6 had a first end surface 20 and a second end surface 22. A hinge means for pivotally connecting the half body 4 with the half body 6 is denoted by the numeral 24.

The apparatus 2 further includes a first housing 26, second housing 28 and third housing 30. In the preferred embodiment, the housing 26,28,30 are spaced at an equal distance apart. The first housing 26 contains the cylindrical projection 32*a* that contains an inner bore 34*a*. The cylindrical projection 32*a* also contains an opening 35*a* therethrough, with the opening at one end containing internal thread means 35*aa* as will be more fully explained later in the application. The cylindrical projection 32*a* contains the insert member 36*a*, with the insert member 36*a* being configured to be inserted within the inner bore 34*a*. The insert member 36*a* is generally cylindrical with a reduced outer diameter 38*a* adapted within the inner bore 34*a*. The insert member 36*a* will also contain the opening 40*a* which is aligned with the opening 35*a* and 35*aa*.

A pin 42*a* is inserted through the openings 35*a*, 40*a*. The pin 42*a* will contain the external thread means 44*a* that will mate with the internal thread means 35*aa* so that the insert 36*a* is fixed within the projection 32*a*. The projection 32*a* also contains thereon the external thread means 46*a* with the top end having a concave surface 48*a*.

A cap member 50*a* is configured to connect to the insert 36*a*. The cap member 50*a* has two open ends, with the first end having internal thread means 52*a* that will engage with the insert's external threads 46*a*. The cap member 50*a* has an outer surface 54*a* that is generally cylindrical, with the outer surface 54*a* concluding at the angled first surface 56*a* and angled second surface 58*a*. There is also a radial shoulder surface 144*a*. As illustrated in FIG. 1, the concave surface 48*a* and the internal portion of the cap member 50*a* form a chamber, with a roller means being disposed therein. In the preferred embodiment, the roller means is a spherical member 60*a* such as a ball bearing. The roller means may further include a plurality of smaller spherical members denoted by the numeral 62*a*. The roller means allows for a rotation of the spherical member in a 360 degree phase in any direction relative to the inner diameter tubular wall. By having the spherical member 60*a* with the underlying smaller spherical members 62*a*, the rotation on the inner diameter tubular wall is facilitated as will be understood by those of ordinary skill in the art. Other roller means for providing rotation are available such as using a linear roller, using a lubricant in place of the spherical members 62*a*, etc.

The second housing 28 is similar in construction and contains the cylindrical projection 32*b* that contains an inner bore 34*b*. The cylindrical projection 32*b* also contains an opening 35*b* therethrough, with the opening at one end containing internal thread means 35*bb*. The cylindrical projection 32*b* contains the insert member 36*b*, with the insert member 36*b* being configured to be inserted within the inner bore 34*b*. The insert member 36*b* is generally cylindrical with a reduced outer diameter 38*b* adapted within the inner bore 34*b*. The insert member 36*b* will also contain the opening 40*b* which is aligned with the opening 35*b* and 35*bb*.

A pin 42*b* is inserted through the openings 35*b*, 40*b*. The pin 42*b* will contain the external thread means 44*b* that will mate with the internal thread means 35*bb* so that the insert 36*b* is fixed within the projection 32*b*. The projection 32*b* also contains thereon the external thread means 46*b* with the top end having a concave surface 48*b*.

A cap member 50*b* is configured to connect to the insert 36*b*. The cap member 50*b* has two open ends, with the first end having internal thread means 52*b* that will engage with the insert's external threads 46*b*. The cap member 50*b* has an outer surface 54*b* that is generally cylindrical, with the outer surface 54*b* concluding at the angled first surface 56*b* and angled second surface 58*b*. There is also a radial shoulder surface 144*b*. As illustrated in FIG. 1, the concave surface 48*b* and the internal portion of the cap member 50*b* form a chamber, with a roller means being disposed therein. In the preferred embodiment, the roller means is a spherical member 60*b* such as a ball bearing. The roller means may further include a plurality of smaller spherical members denoted by the numeral 62*b*. The roller means allows for a rotation of the spherical member in a 360 degree phase in any direction.

The third housing 30 is similar in construction and contains the cylindrical projection that contains an inner bore surface 34*c*. The cylindrical projection is separated into two parts with the first part 70 being configured on the first sleeve half body 4 and the second part 72 also being configured on the second sleeve half body 6. The first part 70 and the second part 72 of the cylindrical projection also contains an opening 35*c* therethrough, with the opening at one end containing internal thread means 35*cc*. The cylindrical projection contains the insert member 36*c*, with the insert member 36*c* being configured to be inserted within the inner bore 34*c*. The insert member 36*c* is generally cylindrical with a reduced outer diameter 38*c* adapted within the inner bore 34*c*. The insert member 36*c* will also contain the opening 40*c* which is aligned with the opening 35*c* and 35*cc*.

A pin 42*c* is inserted through the openings 35*c*, 40*c*. The pin 42*c* will contain the external thread means 44*c* that will mate with the internal thread means 35*cc* so that the insert 36*c* is fixed within the projection 32*c*. The projection 32*c* also contains thereon the external thread means 46*c* with the top end having a concave surface 48*c*.

A cap member 50*c* is configured to connect to the insert 36*c*. The cap member 50*c* has two open ends, with the first end having internal thread means 52*c* that will engage with the insert's external threads 46*c*. The cap member 50*c* has an outer surface 54*c* that is generally cylindrical, with the outer surface 54*c* concluding at the angled first surface 56*c* and angled second surface 58*c*. There is also a radial shoulder surface 144*c*. As illustrated in FIG. 1, the concave surface 48*c* and the internal portion of the cap member 50*c* form a chamber, with a roller means being disposed therein. In the preferred embodiment, the roller means is a spherical member 60*c* such as a ball bearing. The roller means may further include a plurality of smaller spherical members denoted by the numeral 62*c*. The roller means allows for a rotation of the spherical member in a 360 degree phase in any direction.

Figure 2:
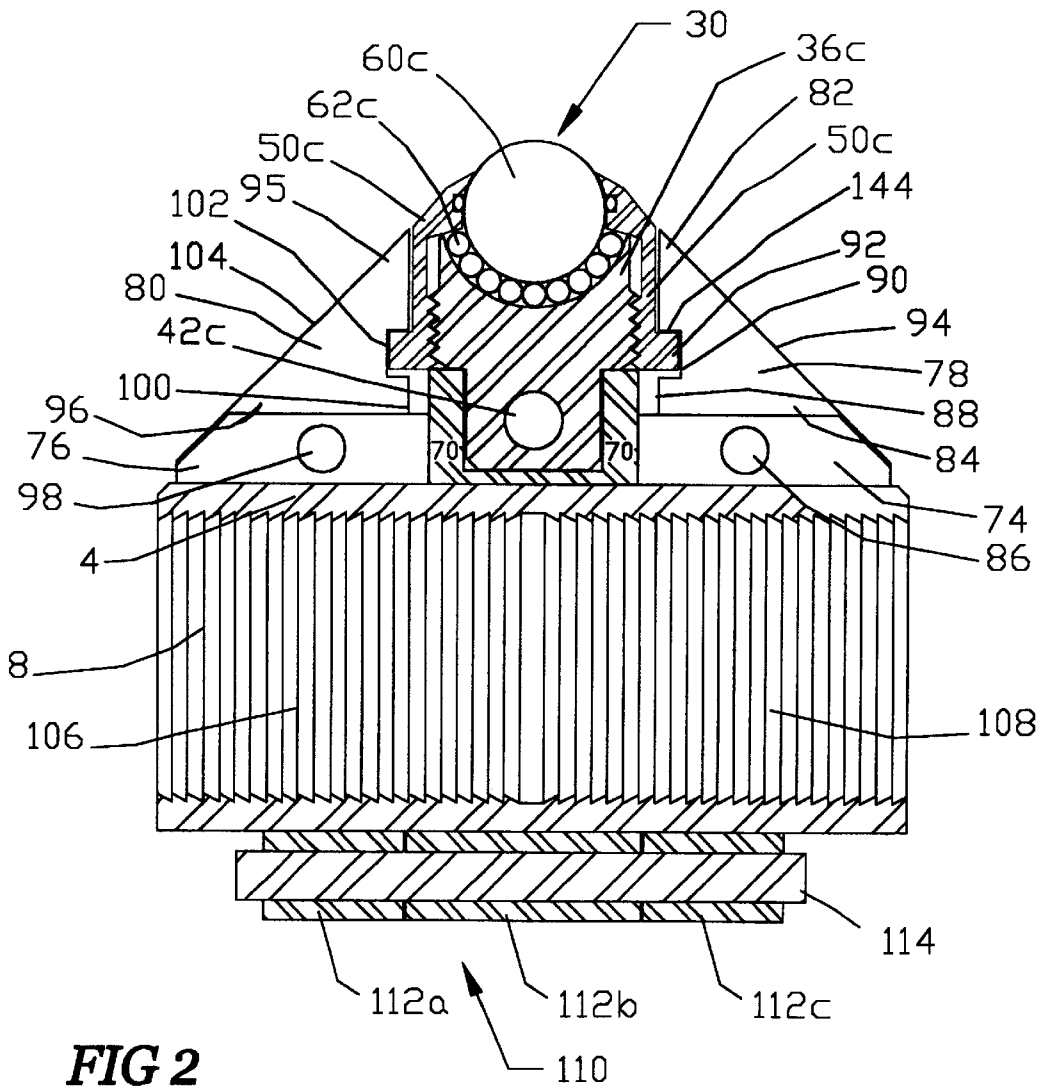
FIG. 2 is a cross-sectional view of novel apparatus of taken along line A—A of FIG. 1.

Referring now to FIG. 2, a cross-sectional view of novel apparatus taken along line A—A of FIG. 1 will now be described. It should be noted that like numbers appearing in the various figures refer to like components. Thus, there is shown the spherical member 60*c* and the plurality of spherical members 62*c* within the chamber. The insert 36*c* is positioned within the first part 70 and second part 72 of the cylindrical projection. The FIG. 2 also depicts a slot member 74 and slot member 76 that runs longitudinally along the same axis of the half bodies 4 and 6 as well as the work string. The purpose of the slot members 74 and 76 is to hold the deflector plates 78 and 80.

The deflector plate 78 is generally in a triangular profile and consist of a first end 82 that is adjacent the cap member 50*c*. The second end 84 runs along the clamp and is fitted into the slot 74. A pin or screw is placed within the opening 86 for affixing the deflector plate 78 to the clamp. The deflector plate 78 has a side 88 that is abutted next to the housing member 30, and therefore, will have a profile notch 90 that has fitted therein a radial shoulder 92 of the cap member 50*c*. The third side, which may be the hypotenuse side of the triangle, is denoted by the numeral 94 and is referred to as the angled side 94 which acts to protect the third housing by deflecting objects. The deflector plates 78 and 80 may also act to strengthen the housing by providing support and reinforcement. The profile notch 90 also acts as lock means for locking the cap member 50*c* by engaging the radial shoulder surface 144*c* of the radial shoulder 92 so that cap 50*c* does not back off or shift.

The deflector plate 80 is similar in construction to plate 78 and consist of a first end 95 that is adjacent the cap member 50*c* on the opposite side relative to the deflector plate 78. The second end 96 runs along the clamp and is fitted into the slot 76. A pin or screw is placed within the opening 98 for affixing the deflector plate 78 to the clamp. The deflector plate 80 has a side 100 that is abutted next to the housing member 30 and also contains a profile notch 102 that has fitted therein the shoulder 92 of the cap member 50*c*. The angled (third) side 104 acts to protect the third housing by deflecting objects. The slot 102 also acts as a lock for the cap member 50*c* by engaging the shoulder surface 144 as noted earlier.

FIG. 2 also illustrates the inner portion 8 of the half body 4. The inner portion 8 contains the series of teeth 106 that are oriented in a first direction and the series of teeth 108 that are oriented in a second direction. The series of teeth are a plurality of rows of annular projections. In the preferred embodiment, the corresponding inner portion 12 will contain a similar arrangement of teeth. The teeth are used to help engage when the apparatus is clamped about the work string.

Also included will be the hinge means 110 for pivotally connecting the first half body 4 to the second half body 6. In the preferred embodiment, the hinge means is a series of tubular sections 112*a*, 112*b*, 112*c* that are attached, such as by welding, to the half bodies. The tubes 112*a* and 112*c* are welded to half body 6 and tube 112*b* is attached to half body 4. The rod 114 is inserted through the tubular sections 112*a*, 112*b*, 112*c*, with the rod 114 being attached, such as by welding, to the ends of tubes 112*a* and 112*c*.

Figure 3:
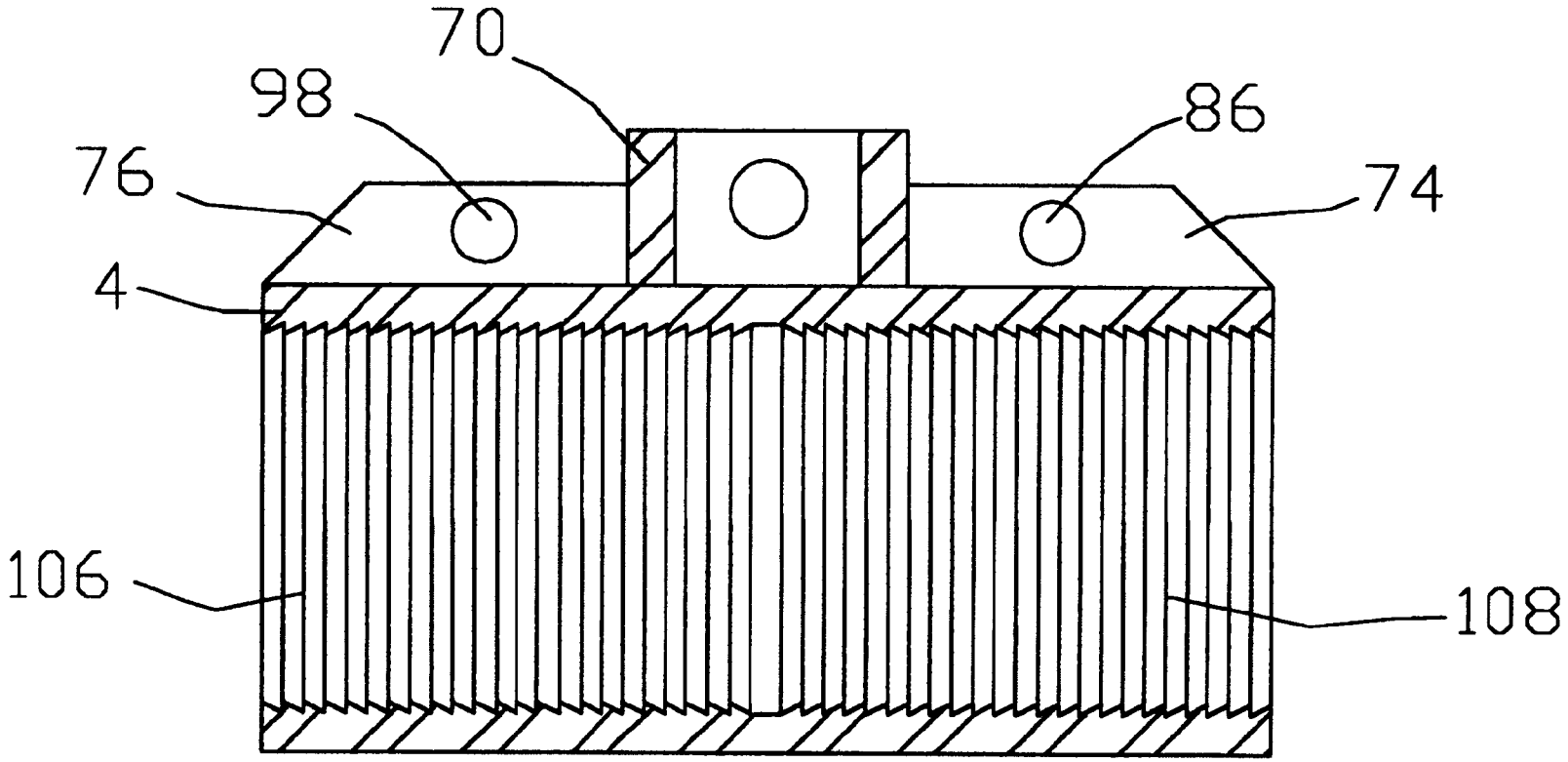
FIG. 3 is the cross-sectional view of the first half sleeve member depicted in FIG. 2.
Figure 4:
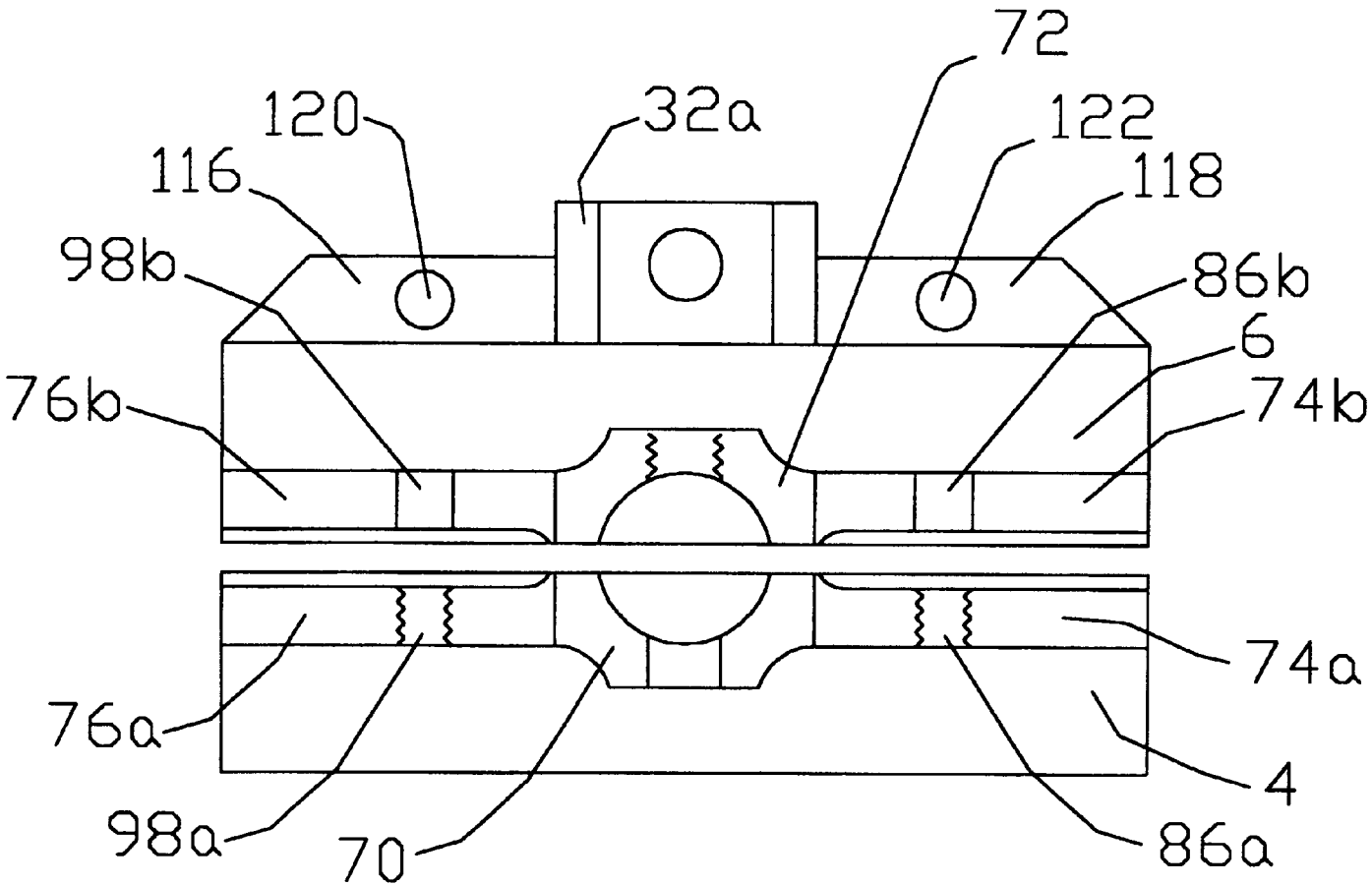
FIG. 4 is top cross-sectional view of the sleeve member of the novel apparatus seen in FIG. 3.

Referring now to FIG. 3, the sleeve half body 4 seen in FIG. 2 is illustrated. As noted earlier, the half body 4 has the slot member 74 and slot member 76 formed thereon along with the openings 86 and 98. Referring now to FIG. 4, a top view of the sleeve half bodies 4 and 6 will now be described. Thus, the slot member 74 contains the slot member rails 74*a*/74*b* and the slot member 76 contains the slot member rails 76*a*/76*b* so that the deflector plates may be inserted therein.

As shown, the rails 76*b* and 74*b* are attached to the second part 72 of the cylindrical projection. The rails 76*a* and 74*a* are attached to the first part 70 of the cylindrical projection. Also depicted is the openings 86*a* and 98, and in particularly, the opening 86*a* showing the internal thread means therein along with the corresponding opening 86*b* for placement of a pin or bolt for attaching the two rails together which in turn attaches the deflector plate in place. The FIG. 4 also shows the opening 98*a* with the internal thread means therein along with the corresponding opening 98*b* for placement of pin or bolt for attaching the two rails together which in turn attaches the deflector plate in place.

FIG. 4 also illustrates the projection 32*a* that is attached to the sleeve 6. The projection 32*a* also has operatively associated therewith the slot member 116 and 118, with the slot members 116,118 being similar in construction and function to slot members 74,76 in that a deflector plate is attached therein. The slot member 116 has an opening 120 and slot member 118 has opening 122 so that the deflector plates may be attached therein.

Figure 5:
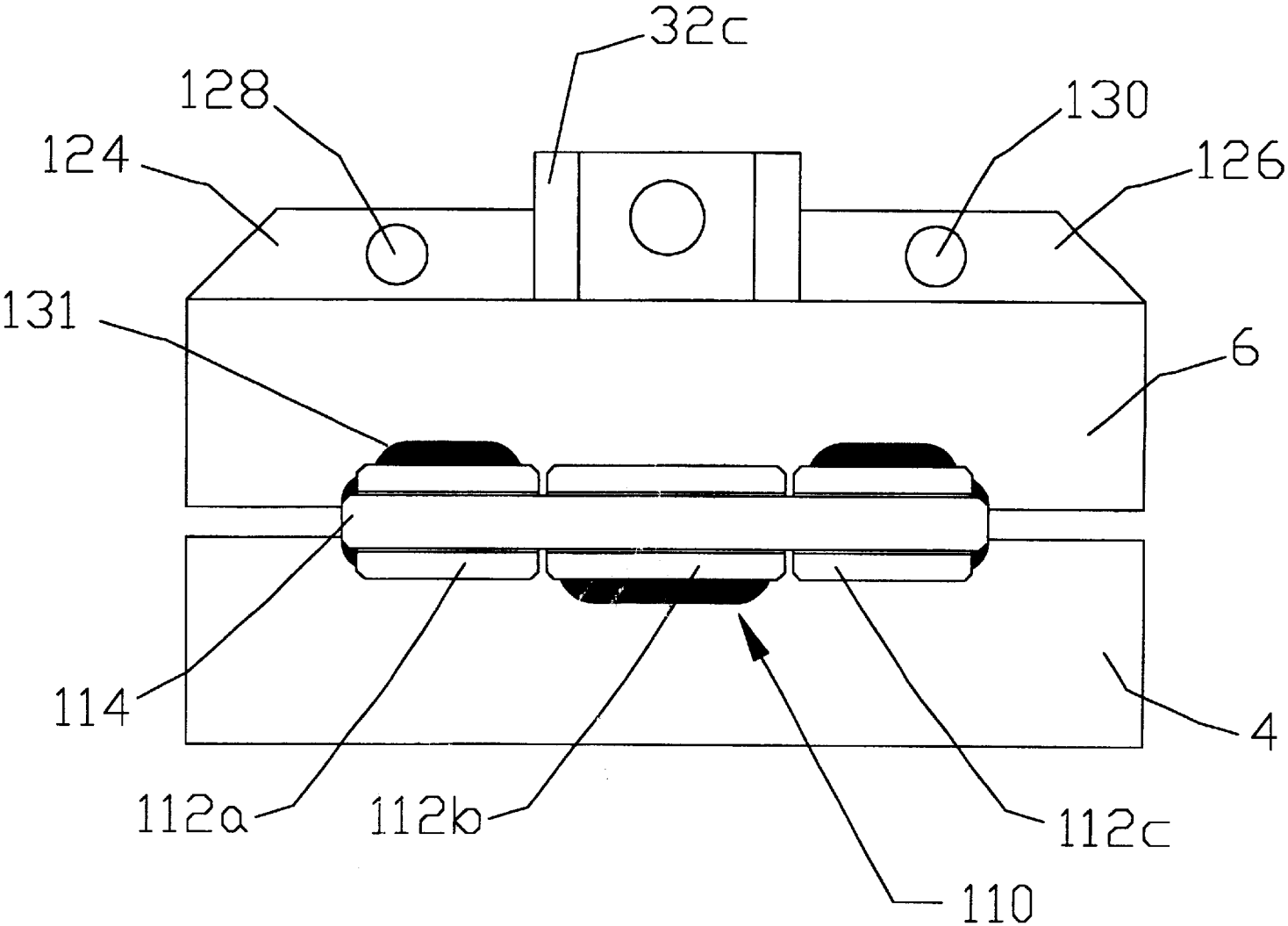
FIG. 5 is a bottom view of the sleeve member with the associated hinge mechanism of the present invention.

Referring now to FIG. 5, an outer view of the hinge means 110 is shown connecting the sleeve 4 to sleeve 6 as previously described. The small tubes 112*a*, 112*c* are welded to the top half of clamp 6. The tube 112*b* is welded to the bottom half clamp 4. The hinge rod 114 is welded to each ends of the hinge tubes 112*a*, 112*c*. FIG. 5 further depicts the cylindrical projection 32*c* along with the slot member 124 and slot member 126, which is similar in construction and function from that depicted in FIG. 4. The slot member 124 has opening 128 and the slot member 126 has the opening 130 for placing a pin therethrough so that the deflector plates may be secured to the slot members 124, 126. The welds 131 are denoted in FIG. 5 in black.

Figure 6:
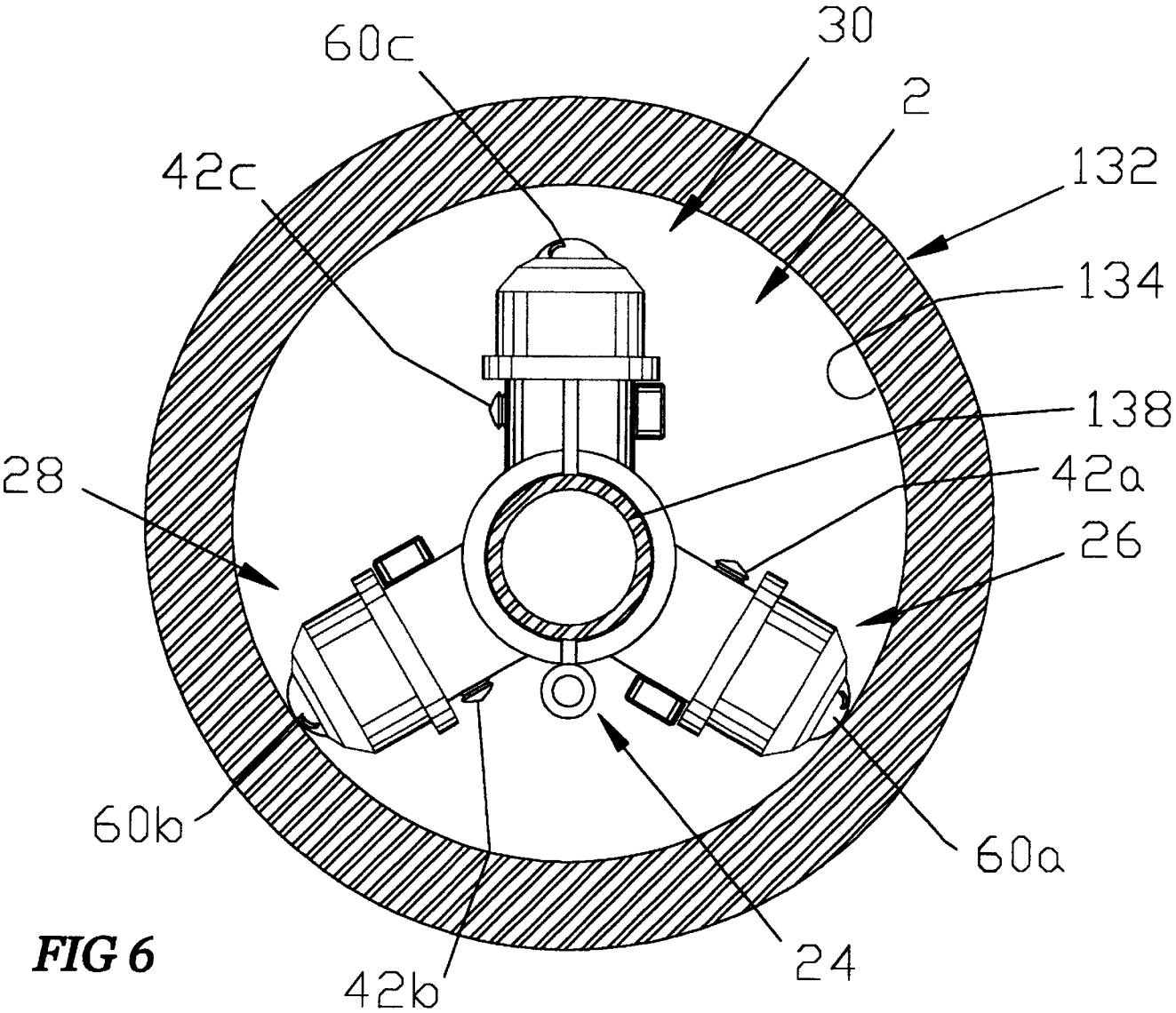
FIG. 6 is a cross-sectional view of the novel apparatus positioned within a highly deviated tubular member.
Figure 7:
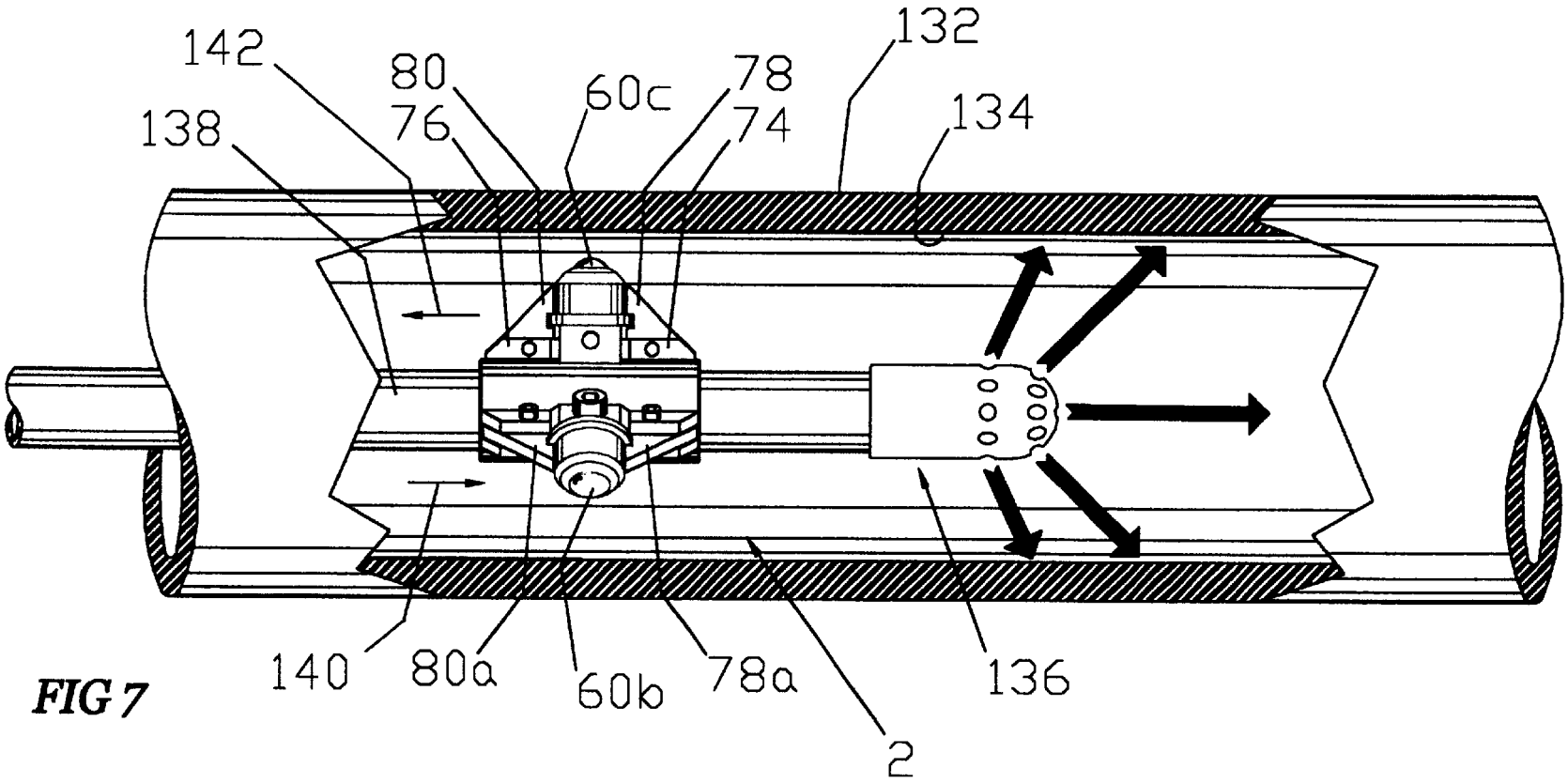
FIG. 7 is a partial cross-sectional view of the novel apparatus assisting the advancement of a work string disposed within a highly deviated tubular member.

FIG. 6 is a cross-sectional view of the novel apparatus 2 positioned within a highly deviated tubular member 132. The tubular member 132 may be a subterranean well bore or a pipeline or a flowline. The tubular member 132 has the inner diameter portion 134. Thus, the apparatus 2 is thus situated on a work string within the tubular 132. The roller members 60*a* and 60*b* will contact the inner diameter 134 due to gravity as shown. As the work string 138 winds and unwinds in advancement, the work string 138 will rotate torsionally. The roller members 60*a*, 60*b*, 60*c* will accommodate this by rotating in any direction greatly reducing drag on the walls of the tubular. The roller members 60*a*, 60*b*,60*c* can rotate forward, backward, sideways and any component thereof FIG. 7 depicts the apparatus 2 within the tubular member 132 with an actual wash tool 136 attached at one end of the work string 138. Thus, the skate apparatus 2 is clamped about the work string 138 as previously described. This figure illustrates the apparatus 2 as previously discussed along with deflector plates 78*a*, 80*a*. Other skates may be added depending on the length of the work string, severity of deviated, number of dog legs, etc. Generally, the apparatus may be placed at 20 foot intervals to minimize drag associated with the corkscrewed work string, such as a coiled tubing string, laying on the bottom of the horizontal tubular, such as a casing string.

As shown in FIG. 7, by using the skates in conjunction with a high pressure wash nozzle, far greater clean out distances can be achieved, with one of the advantages being the ease of advancing and retracting the work string due to the novel design herein disclosed. Other types of tools may be associated with the end of the work string such as packers, plugs, valves, screens, etc. The operator would essentially impart a force in a first direction in order to move work string 138 further into the tubular 132 (denoted by the arrow 140). In order to move the work string in a second direction such as to retrieve the work string, a force is imparted in a second direction as seen by arrow 142. If an object is located within the inner diameter 134 of the tubular 132, the deflector plates will act to deflect the object, as well as protect the rollers as previously described. In other words, the angled end of the deflector plate will deflect an object in the inner diameter 134 away from the rollers 60*b*.

Figure 8:
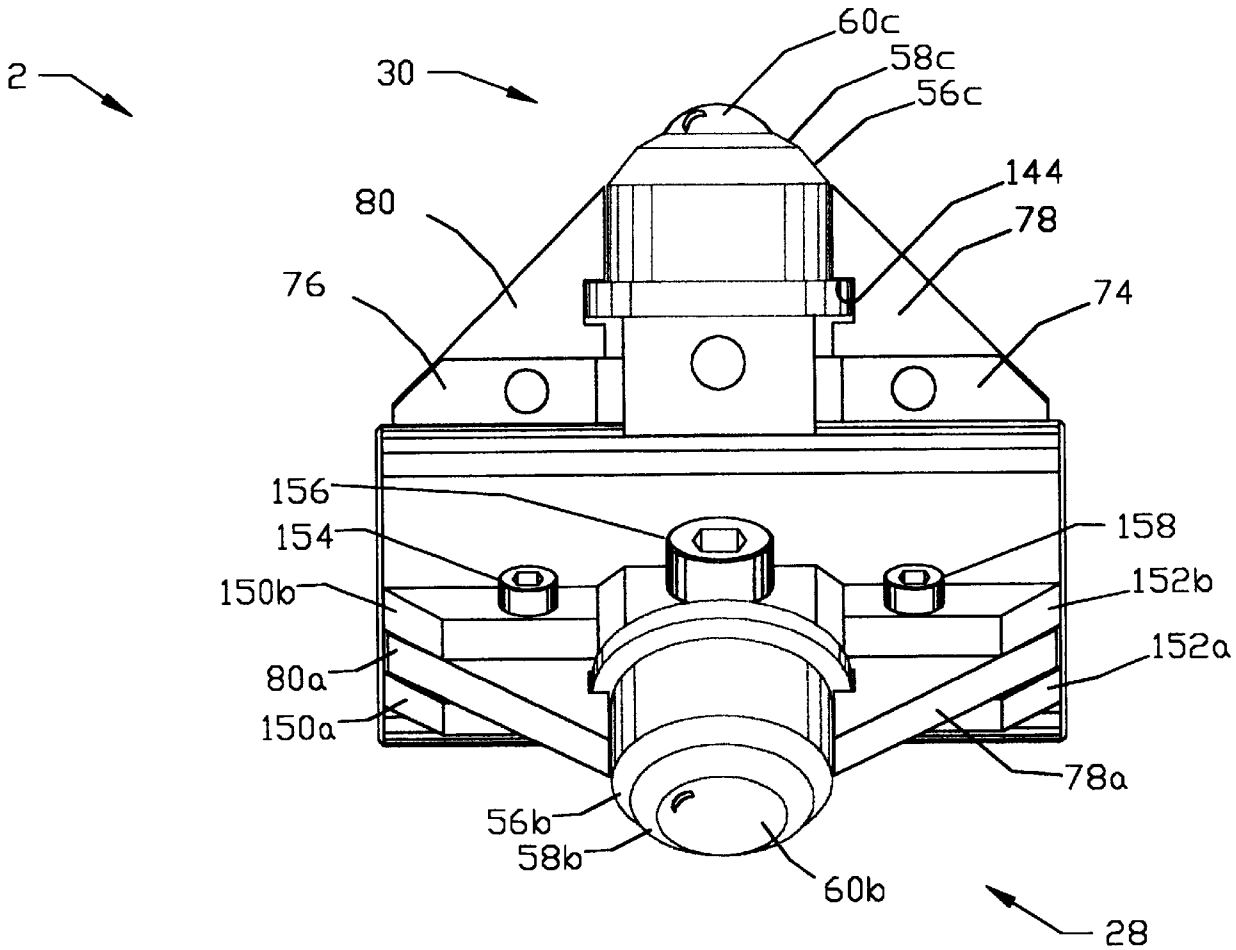
FIG. 8 is a perspective view of the novel apparatus.

FIG. 8 depicts a three dimensional perspective view of the apparatus 2 including the housing 28,30. Also shown is the deflector plates 78*a*,80*a* which are inserted into the slot members 150*a*, 150*b* and 152*a*, 152*b* respectively. Fasteners 154,156, and 158 attach the deflector plates 78,80 and housing 28 into place as previously shown.

Changes and modifications in the specifically described embodiments can be carried out without departing from the scope of the invention which is intended to be limited only by the proper and legal scope of the appended claims.

I claim:

1. An apparatus for attaching to a tubular work string comprising:

a cylindrical member having a first half clamp having an arcuate inner portion and a second half clams having an arcuate inner portion, and wherein a hinge connects said first half clamp with said second half clamp about the tubular work string;

a first housing member attached to said first half clamp;

a second housing member attached to said second half clamp;

wherein said first housing and said second housing comprise: a first and second cylindrical projection mounted perpendicular relative to the tubular work string; a first and second insert disposed within said cylindrical projection; a first and second cap member having an opening therein, said first and second cap member being attached to said insert, and wherein said cap member and said insert form a first and second chamber;

a first spherical roller member inserted into said chamber and being rotatable within said first housing in a forward, backward, sideways direction and any component thereof;

a second spherical roller member inserted into said second housing member and being rotatable within said second housing in a forward, backward, sideways direction and any component thereof;

a third housing member containing a first half-cylindrical projection mounted on said first half clamp and a second half-cylindrical projection mounted on said second half clamp, and wherein said first half-cylindrical projection and said second half-cylindrical projection form a third cylindrical member; a third insert disposed within said third cylindrical member; a third cap member having an opening therein, said third cap member being attached to said third insert, and wherein said third cap member and said third insert form a third chamber that contains a third spherical roller, with a portion of said third spherical member protruding from said opening of said cap;

clamping means for attaching said first half-cylindrical projection with said second half-cylindrical projection about the tubular work string.

2. The apparatus of claim wherein said inner portion of said first half clamp and said second half clamp contains a series of annular teeth that engage the tubular work string.

3. The apparatus of claim 2 further comprising:

a first deflector plate operatively associated with a first side of said first housing, said first deflector plate having a first end adjacent said first cap member and a second end adjacent said first half clamp so that an angled end is formed;

a first notch profile formed on said first deflector plate engaging a first shoulder on said first housing member.

4. The apparatus of claim 3 further comprising:

a second deflector plate operatively associated with a second side of said second housing, said second deflector plate having a first end adjacent said cap member and a second end adjacent said second half clamp so that an angled end is formed;

a second notch profile formed on said second deflector plate engaging a second shoulder on said second housing.

5. The apparatus of claim 2 wherein said clamping means comprises: a passage through said first half-cylindrical projection and said second half-cylindrical projection; a pin placed within said passage; external thread means located on said pin; internal thread means located in said passage and adapted to threadedly engage said external thread means; and wherein said threadedly engagement of said pin within said passage tightens said first half clamp and said second half clamp about the tubular work string.

6. A method for advancing a tubular work string within a highly deviated well bore comprising:

clamping a skate apparatus about the tubular work string, said skate apparatus comprising: a clamp; a first housing member attached to said clamp, said first housing member having a first spherical roller disposed therein; a second housing member attached to said clamp, said second housing member having a second spherical roller disposed therein; a third housing member attached to said clamp, said third housing member having a third spherical roller disposed therein; a first deflector plate operatively associated with a first side of said first, second, and third housing, said first deflector plate having a first end adjacent a top end of said first, seconds and third housing and a second end adjacent said clamp so that an angled end is formed; and, a notch profile on said first deflector plate engaging a shoulder on said first housing;

placing said skate apparatus about the tubular work string in the highly deviated well bore;

contacting said first spherical roller and said second spherical roller on an inner portion of the tubular work string;

imparting a force in a first direction on the tubular work string;

rolling said first spherical roller and said second spherical roller on the inner portion of the tubular work string;

advancing the tubular work string in the first direction in the highly deviated well bore;

contacting the first object with the first deflector plate;

engaging the notch profile with said shoulder on said housing so that said first housing is locked in place;

deflecting the first object on said angled end of said deflector plate.

7. The method of claim 6 wherein said skate apparatus further comprises a second deflector plate attached to a second side of said first housing, said second housing and said third housing, said second deflector plate having a first end adjacent said cap member and a second end adjacent said clamp so that an angled end is formed; and the method further comprises:

imparting the force in a second direction on the tubular work string;

rolling said first spherical roller and said second spherical roller on the inner diameter portion of the tubular work string;

advancing the tubular work string in the second direction in the highly deviated well bore.

8. The method of claim 7 wherein said well bore contains a second object, and the method further comprises:

contacting the second object with the second deflector plate;

deflecting the second object on said angled end of said second deflector plate.

9. A device for assisting the advancement of a tubular string located within a well bore comprising:

a clamp having a first part and a second part, and wherein said first part and said second part are hinged together, and wherein said clamp is concentrically disposed about the tubular string;

a first housing member attached to said first part of said clamp, said first housing member having a first spherical member inserted therein, said first spherical member being rotatable in a forward, backward, and sideways direction, and any component thereof;

a second housing member attached to said second part of said clamp, said second housing member having a second spherical member inserted therein, said second spherical member being rotatable in the forward, backward, and sideways direction, and any component thereof;

a first deflector plate mounted to a first side of said first housing member and said second housing member, said first deflector plate forming an angled side relative to said clamp and having a first notch profile on the first deflector plate engaging a shoulder on said first housing member so that said first housing member does not back off from said first part of said clamp;

a second deflector plate mounted to a second side of said first housing member and said second housing member, said second deflector plate forming an angled side relative to said clamp and having a second notch profile on the first deflector plate engaging a shoulder on said first housing member so that said first housing member does not back off from said second part of said clamp.

10. The device of claim 9 wherein said first housing member and said second housing member comprise:

a first and second cylindrical projection mounted perpendicular relative to the tubular work string;

a first and second insert disposed within said first and second cylindrical projection;

a first and second cap member having an opening therein, said first and second cap member being attached to said first and second insert, and wherein said first and second cap member and said first and second insert form a first and second chamber, and wherein said first and second chamber contains said first and second spherical member disposed therein, and wherein a portion of said first and second spherical member protrudes from said opening of said first and second cap.

11. The device of claim 10 wherein said clamp contains an internal portion, and wherein said internal portion contains a series of teeth which engage the tubular work string.

12. The device of claim 11 further comprising:

a third housing member containing a first cylindrical projection mounted perpendicular relative to the first part of said clamp and a second cylindrical projection mounted perpendicular relative to the second part of said clamp, and wherein said first cylindrical projection and said second projection form a cylindrical member;

a third insert disposed within said cylindrical member;

a third cap member having an opening therein, said third cap member being attached to said third insert, and wherein said third cap member and said third insert form a third chamber, and wherein said third chamber contains a third spherical member disposed therein, and wherein a portion of said third spherical member protrudes from said opening of said third cap member.

* * * * *